US009354540B2

(12) United States Patent
Kumada et al.

(10) Patent No.: US 9,354,540 B2
(45) Date of Patent: May 31, 2016

(54) IMAGE FORMING APPARATUS WHICH USES ELECTROSTATIC LATENT IMAGE FOR COLOR MISREGISTRATION CORRECTION

(71) Applicant: CANON KABUSHIKI KAISHA, Tokyo (JP)

(72) Inventors: Hiromitsu Kumada, Susono (JP); Hiroshi Hagiwara, Suntou-gun (JP); Takateru Ohkubo, Susono (JP); Akinobu Hirayama, Mishima (JP); Yoshiko Kubo, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/499,488

(22) Filed: Sep. 29, 2014

(65) Prior Publication Data

US 2015/0016832 A1 Jan. 15, 2015

Related U.S. Application Data

(63) Continuation of application No. 13/687,188, filed on Nov. 28, 2012, now Pat. No. 8,879,970.

(30) Foreign Application Priority Data

Jan. 31, 2012 (JP) ..... 2012-018640

(51) Int. Cl.
*G03G 15/00* (2006.01)
*G03G 15/043* (2006.01)
(Continued)

(52) U.S. Cl.
CPC ..... *G03G 15/043* (2013.01); *G03G 15/0131* (2013.01); *G03G 15/0189* (2013.01);
(Continued)

(58) Field of Classification Search
CPC ..... G03G 15/0131; G03G 15/0178; G03G 15/043; G03G 15/0189; G03G 15/0266; G03G 15/5037; G03G 15/5058; G03G 2215/0161; G03G 15/50
USPC ..... 301/301; 347/116
See application file for complete search history.

(56) References Cited

U.S. PATENT DOCUMENTS 6,771,919 B2 8/2004 Koide
7,634,202 B2 12/2009 Kitazawa et al.
(Continued)

FOREIGN PATENT DOCUMENTS

CN 101334619 A 12/2008
CN 102314114 A 1/2012
(Continued)

OTHER PUBLICATIONS

Office Action issued in Chinese Patent Application No. 201310031403.8, dated Dec. 22, 2014.

*Primary Examiner* — Clayton E Laballe
*Assistant Examiner* — Ruifeng Pu
(74) *Attorney, Agent, or Firm* — Fitzpatrick, Cella, Harper & Scinto

(57) ABSTRACT

An image forming apparatus includes a control unit configured to form electrostatic latent images for correction on a photosensitive member; a voltage application unit configured to apply a voltage to a process unit; a current detection unit configured to detect a current to the voltage application unit via the process unit when the voltage is applied to the process unit; and a conversion unit configured to convert an output value detected by the current detection unit such that a variation range of the output value detected by the current detection unit at a formation period of the electrostatic latent image for correction becomes larger than a variation range of the output value detected by the current detection unit at a one-rotation period of the photosensitive member on which the electrostatic latent image is not formed.

15 Claims, 14 Drawing Sheets

(51) Int. Cl.
*G03G 15/01* (2006.01)
*G03G 15/02* (2006.01)

(52) U.S. Cl.
CPC ..... *G03G15/0266* (2013.01); *G03G 15/50* (2013.01); *G03G 15/5037* (2013.01); *G03G 15/5058* (2013.01); *G03G 2215/0161* (2013.01)

(56) References Cited

U.S. PATENT DOCUMENTS

| | | | |
|---|---|---|---|
| 8,068,755 | B2 | 11/2011 | Kojima |
| 8,086,155 | B2 | 12/2011 | Yamaguchi et al. |
| 8,600,274 | B2 | 12/2013 | Uchiyama et al. |
| 8,891,984 | B2 | 11/2014 | Uchiyama et al. |
| 2003/0021613 | A1 | 1/2003 | Koide |
| 2008/0085131 | A1 | 4/2008 | Kitazawa et al. |
| 2009/0080924 | A1 | 3/2009 | Kojima |
| 2012/0003016 | A1 | 1/2012 | Uchiyama et al. |

FOREIGN PATENT DOCUMENTS

| | | | |
|---|---|---|---|
| JP | 07-61037 | A | 3/1995 |
| JP | 7-234612 | A | 9/1995 |
| JP | 2002-072607 | A | 3/2002 |
| JP | 2003-005490 | A | 1/2003 |
| JP | 2003-156905 | A | 5/2003 |
| JP | 2012-014176 | A | 1/2012 |

IMAGE FORMING APPARATUS WHICH USES ELECTROSTATIC LATENT IMAGE FOR COLOR MISREGISTRATION CORRECTION

This application is a continuation of U.S. patent application Ser. No. 13/687,188, filed Nov. 28, 2012, which claims the benefit of Japanese Patent Application No. 2012-018640, filed on Jan. 31, 2012, which are hereby incorporated by reference herein in their entirety.

BACKGROUND OF THE INVENTION

1. Field of the Invention

The present invention relates to an image forming apparatus using electrophotography and, more particularly, to a color misregistration detection technique in an image forming apparatus.

2. Description of the Related Art

An electrophotographic image forming apparatus called a tandem type is known. This tandem-type image forming apparatus is configured to sequentially transfer images from the image forming stations of the respective colors to the intermediate transfer belt and then transfer the images from the intermediate transfer belt to a printing medium at once.

In such an image forming apparatus, when the images are superimposed, color misregistration (positional shift) may occur due to the mechanical factors of the image forming stations of the respective colors. Especially in an arrangement in which each image forming station is provided with a photosensitive member and a scanner unit for scanning the photosensitive member, the positional relationship between the scanner unit and the photosensitive member changes between the colors. This impedes synchronization of laser beam scanning positions on the photosensitive members and causes color misregistration.

To correct the color misregistration, the image forming apparatus performs color misregistration correction control. In Japanese Patent Laid-Open No. 7-234612, position detection toner images of the respective colors are transferred from the photosensitive members to an image carrier such as an intermediate transfer belt. The positions of the respective color toner images relative to a reference color toner image are detected using a sensor, thereby performing the color misregistration correction control.

In the arrangement according to the related art, however, since the position detection toner images are formed on the image carrier, the toners are consumed, and a time is required for cleaning the toners, lowering the usability of the image forming apparatus.

SUMMARY OF THE INVENTION

The present invention provides an image forming apparatus that suppresses toner consumption and prevents usability from lowering.

According to an aspect of the present invention an image forming apparatus includes: an image forming unit including a photosensitive member, a scanning unit configured to scan the photosensitive member by light corresponding to image data to form an electrostatic latent image on the photosensitive member, and a process unit configured to act on the photosensitive member for image formation; a control unit configured to control to form a plurality of electrostatic latent images for correction for color misregistration correction on the photosensitive member; a voltage application unit configured to apply a voltage to the process unit; a current detection unit configured to detect a current that flows to the voltage application unit via the process unit when the voltage application unit applies the voltage to the process unit; and a conversion unit configured to convert an output value detected by the current detection unit such that a variation range Vp of the output value detected by the current detection unit at a formation period Tp of the electrostatic latent image for correction becomes larger than a variation range Vd of the output value detected by the current detection unit at a one-rotation period Td of the photosensitive member on which the electrostatic latent image for correction is not formed.

Further features of the present invention will become apparent from the following description of exemplary embodiments with reference to the attached drawings.

DESCRIPTION OF THE EMBODIMENTS

The embodiments of the present invention will now be described with reference to the accompanying drawings. The following embodiments are merely examples and do not limit the present invention.

First Embodiment

Figure 1:
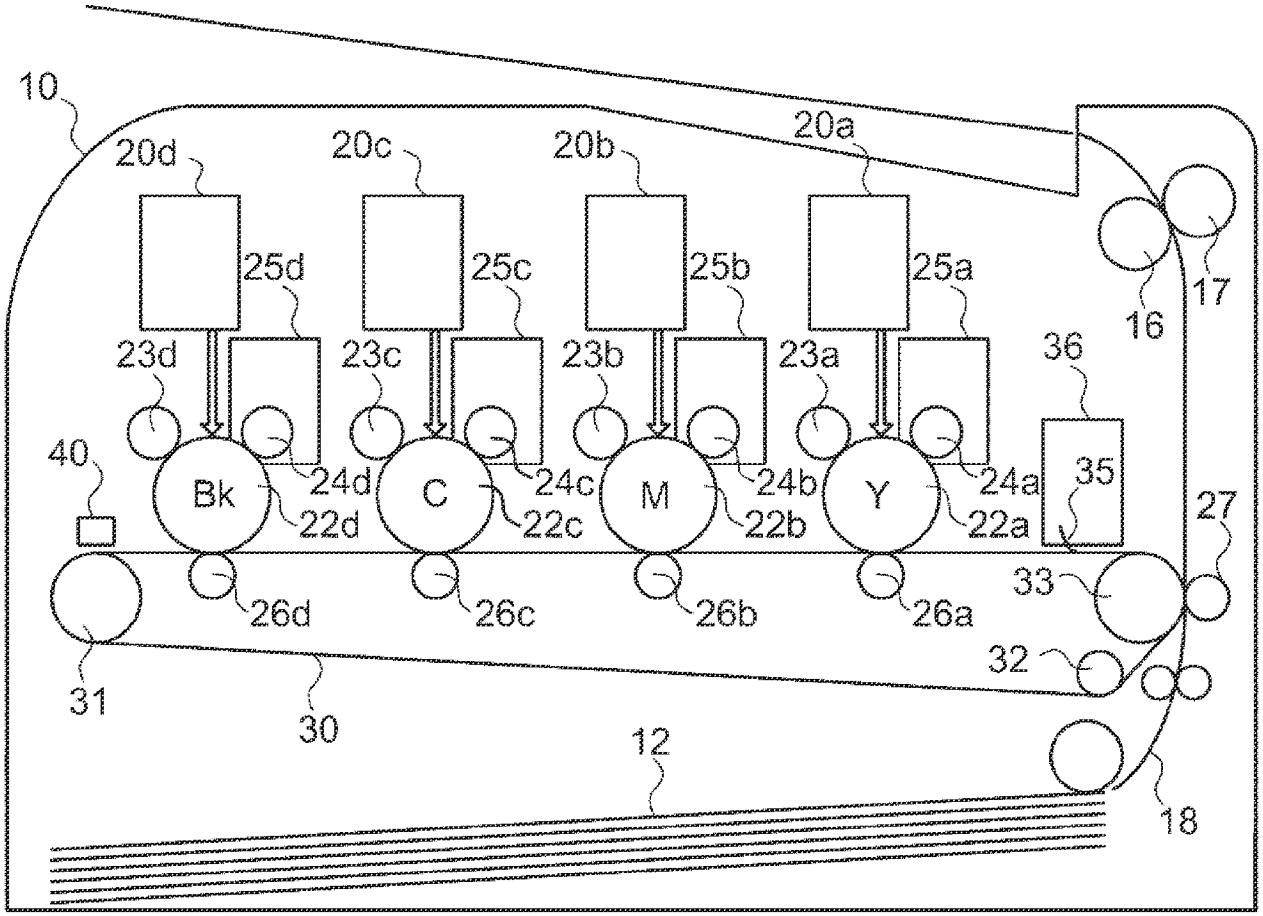
FIG. 1 is a view showing the arrangement of an image forming unit of an image forming apparatus according to an embodiment.

FIG. 1 is a view showing the arrangement of an image forming unit 10 of an image forming apparatus according to the present embodiment. Note that the lower-case alphabetic characters a, b, c, and d added to reference numerals as suffixes indicate that the members of interest correspond to yellow (Y), magenta (M), cyan (C), and black (Bk). Reference numerals without the suffixes a, b, c, and d in the lower-case alphabetic characters are used when the colors need not be discriminated. A photosensitive member 22 is an image carrier and is rotatably driven. A charging roller 23 charges the surface of the corresponding photosensitive member 22 to a uniform potential. For example, the charging bias output from the charging roller 23 is −1200 V, and the surface of the photosensitive member 22 is charged by this to a potential (dark potential) of −700 V. A scanner unit 20 scans the surface of the photosensitive member 22 by a laser beam corresponding to the image data of an image to be formed, thereby forming an electrostatic latent image on the photosensitive member 22. For example, the potential (bright potential) of the portion where the electrostatic latent image is formed by scanning of the laser beam is −100 V. A developing device 25 includes a toner of a corresponding color and supplies the toner to the electrostatic latent image on the photosensitive member 22 via a developing sleeve 24, thereby developing the electrostatic latent image on the photosensitive member 22. For example, the developing bias output from the developing sleeve 24 is −350 V, and the developing device 25 applies the toner to the electrostatic latent image by this potential. A primary transfer roller 26 transfers the toner image that is formed on the photosensitive member 22 to an intermediate transfer belt 30 that is an image carrier and is orbitally driven by rollers 31, 32, and 33. For example, the transfer bias output from the primary transfer roller 26 is +1000 V, and the primary transfer roller 26 transfers the toner to the intermediate transfer belt 30 by this potential. Note that the toner images on the photosensitive members 22 are transferred to the intermediate transfer belt 30 in a superimposed manner, thereby forming a color image.

A secondary transfer roller 27 transfers the toner image on the intermediate transfer belt 30 to a printing medium 12 conveyed through a conveyance path 18. A pair of fixing rollers 16 and 17 heat and fix the toner image transferred to the printing medium 12. A cleaning blade 35 collects, in a waste toner container 36, the toner that was not transferred by the secondary transfer roller 27 from the intermediate transfer belt 30 to the printing medium 12. In addition, a detection sensor 40 is provided while facing the intermediate transfer belt 30 to correct color misregistration by forming a conventional toner image.

Note that the scanner unit 20 may have a form to scan the photosensitive member 22 not by a laser but by an LED array or the like. Instead of providing the intermediate transfer belt 30, the image forming apparatus may transfer the toner images on the photosensitive members 22 directly to the printing medium 12.

Figure 2:
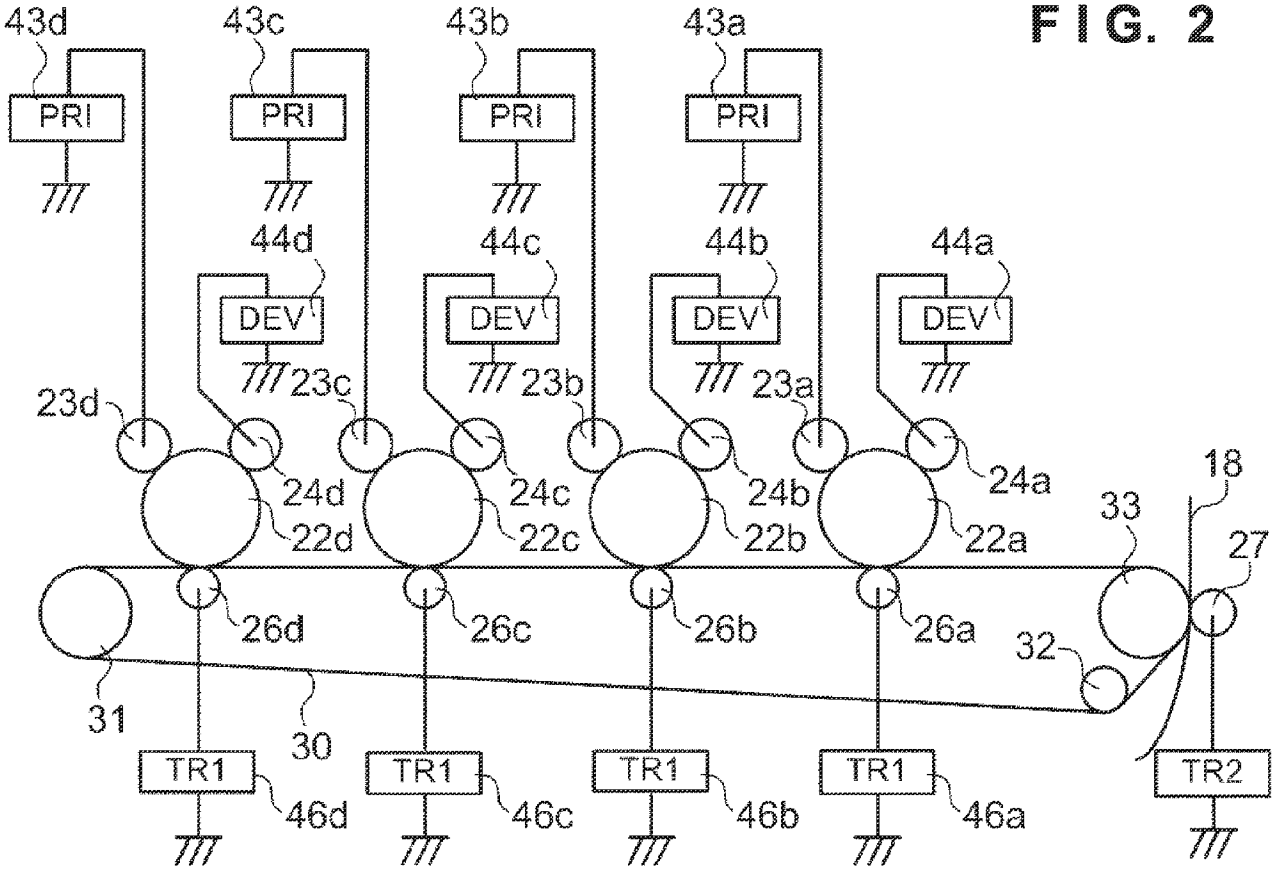
FIG. 2 is a view showing a system for supplying a high-voltage power to the image forming unit according to an embodiment.

FIG. 2 is a view showing a system for applying high voltages to the respective process units of the image forming unit 10. A process unit is a member including one of the charging roller 23, the developing device 25, and the primary transfer roller 26, and acts on the photosensitive member 22 for image formation. A charging high-voltage power supply circuit 43 applies a voltage to the corresponding charging roller 23. A developing high-voltage power supply circuit 44 applies a voltage to the developing sleeve 24 of the corresponding developing device 25. A primary transfer high-voltage power supply circuit 46 applies a voltage to the corresponding primary transfer roller 26. The charging high-voltage power supply circuit 43, the developing high-voltage power supply circuit 44, and the primary transfer high-voltage power supply circuit 46 function as voltage application units for the process units.

The charging high-voltage power supply circuit 43 according to the present embodiment will be described next with reference to FIG. 3. A transformer 62 boosts the voltage of an AC signal generated by a driving circuit 61 to an amplitude of several ten times. A rectifying circuit 51 formed from diodes 1601 and 1602 and capacitors 63 and 66 rectifies and smoothes the boosted AC signal. The rectified and smoothed signal is output from an output terminal 53 to the charging roller 23 as a DC voltage. An operational amplifier 60 controls the output voltage of the driving circuit 61 such that a voltage obtaining by causing detection resistors 67 and 68 to divide the voltage of the output terminal 53 equals a voltage set value 55 set by an engine control unit 54. A current flows via the charging roller 23, the photosensitive member 22, and ground in accordance with the voltage of the output terminal 53.

A current detection circuit 50 is provided to output a detected voltage 562 corresponding to the current. The detected voltage 562 is input to the inverting input terminal of a comparator 74. The noninverting input terminal of the comparator 74 receives a reference voltage 75 generated by causing resistors 86 and 87 to divide a predetermined voltage. The comparator 74 outputs, to the engine control unit 54, a binarized voltage 561 corresponding to the comparison of the detected voltage 562 and the reference voltage 75. More specifically, the output of the comparator 74 is "high" when the detected voltage 562 is lower than the reference voltage 75, and "low" otherwise.

In the present embodiment, color misregistration is corrected by a latent image mark that is an electrostatic latent image formed on the photosensitive member 22 for color misregistration correction, as will be described later. Also as will be described later, when the latent image mark is passing through the position of the charging roller 23, the current flowing via the charging roller 23, the photosensitive member 22, and ground increases, and the detected voltage 562 decreases as compared to other cases. To detect the passage of the latent image mark, the reference voltage 75 serving as a threshold is set to a value between the detected voltage 562 when no latent image mark exists and its minimum value when the latent image mark passes through the position of the charging roller 23. With this arrangement, when the latent image mark passes through the position of the charging roller 23, the comparator 74 outputs the binarized voltage 561 having one leading edge and one subsequent trailing edge to the engine control unit 54. The engine control unit 54 specifies, for example, the middle point between the leading edge and the trailing edge of the binarized voltage 561 as the latent image mark detection position. Note that the engine control unit 54 may detect one of the leading edge and the trailing edge of the binarized voltage 561 as the latent image mark detection position.

The current detection circuit 50 shown in FIG. 3 will be explained next. The current detection circuit 50 is inserted between a ground point 57 and a secondary-side circuit 500 of the transformer 62. When a desired voltage is output to the output terminal 53, a current flows to the current detection circuit 50 via the photosensitive member 22, the charging roller 23, and the ground point 57. The inverting input terminal of the operational amplifier 70 is connected (negatively fed back) to the output terminal via a resistor 71 and is therefore virtually grounded to a reference voltage 73 connected to the noninverting input terminal. Hence, a detected voltage 56 that is an output value proportional to the amount of the current flowing to the output terminal 53 appears in the output terminal of the operational amplifier 70. In other words, when the current flowing to the output terminal 53 changes, the detected voltage 56 not in the inverting input terminal of the operational amplifier 70 but in the output terminal of the operational amplifier 70 changes, and the current flowing via the resistor 71 thus changes. Note that a capacitor 72 is used to stabilize the inverting input terminal of the operational amplifier 70.

The detected voltage 56 corresponding to the detected current amount is input to the noninverting input terminal of an operational amplifier 78 via a low-pass filter formed from a resistor 76 and a capacitor 77. The low-pass filter is used to remove high-frequency noise generated at the switching period of the transformer 62. The operational amplifier 78 controls the output voltage such that the voltage input to the noninverting input terminal of the operational amplifier 78 equals the voltage of the inverting input terminal. The output voltage of the operational amplifier 78 is input to a high-pass filter formed from a capacitor 79, resistors 81 and 82, and an operational amplifier 85. The constants of the capacitor 79 and the resistor 81 are decided such that the low-frequency voltage variation in the output voltage of the operational amplifier 78 is attenuated by the high-pass filter. The low-frequency voltage variation is a voltage variation that occurs at a period corresponding to the time of one rotation of the photosensitive member 22.

Figure 4A:
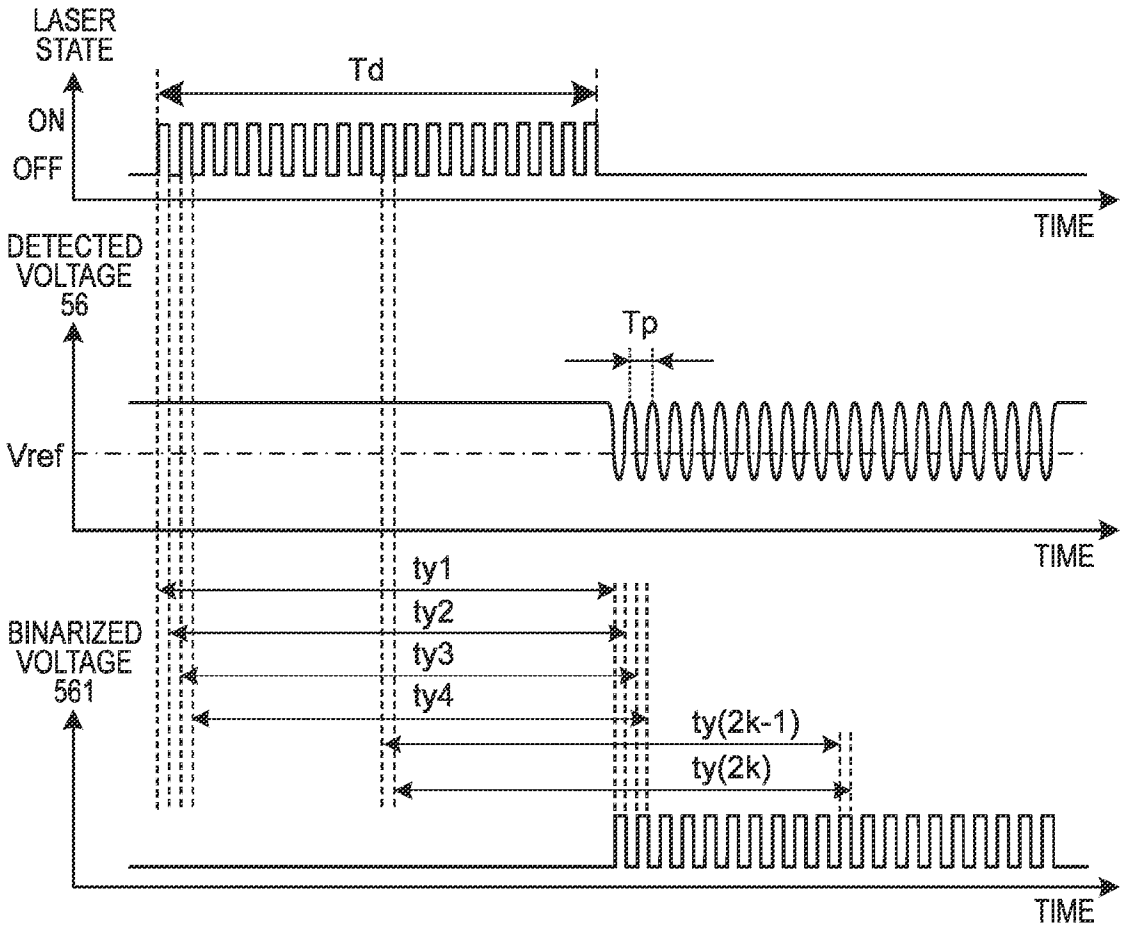
FIGS. 4A to 4C are timing charts of a detected voltage output from a current detection circuit.

The reason why the high-pass filter is provided will be described here in more detail. FIG. 4A shows the state of the laser beam when forming the latent image mark on the photosensitive member 22 and the waveforms of the detected voltage 56 and the binarized voltage 561 when the wear amount of the photosensitive member 22 is small. Let ty(2k–1) be the time from the kth on/off timing of the laser beam to detection of the kth pulse edge of the binarized voltage 561. At this time, a voltage variation by the latent image mark appears in the detected voltage 56. In an arrangement without the high-pass filter, the detected voltage 56 is directly input to the comparator 74. Hence, the detected voltage 56 is compared with the reference voltage 75 represented by Vref in FIGS. 4A to 4C, thereby outputting the binarized voltage 561.

Figure 4B:
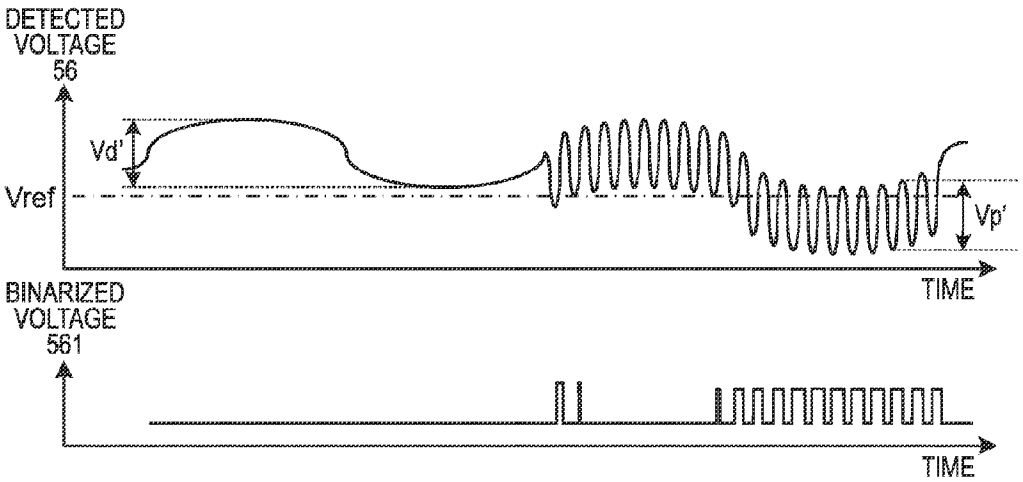

FIG. 4B shows the waveforms of the detected voltage 56 and the binarized voltage 561 when the wear amount of the photosensitive member 22 is large. As the photosensitive member 22 rotates, the photosensitive layer on its surface is gradually scraped. The current flowing to the charging roller 23 increases in accordance with the wear amount of the photosensitive layer. In addition, the wear amount of the photosensitive layer of the photosensitive member 22 changes in the circumferential direction because of the decenter of the axis. For this reason, as the number of printed sheets increases, and the accumulated rotation time of the photosensitive member 22 prolongs, the current flowing to the charging roller 23 increases. In addition, the current varies in accordance with the one-rotation period of the photosensitive member 22. If the variation in the current flowing to the charging roller 23 becomes large, the variation in the detected voltage 56 becomes large, as shown in FIG. 4B. At this time, if no high-pass filter exists, the latent image mark cannot properly be detected by the binarized voltage 561 output from the comparator 74, as shown in FIG. 4B. As a result, the color misregistration detection accuracy degrades. To prevent degradation of the color misregistration detection accuracy, the voltage variation at the one-rotation period of the photosensitive member 22 needs to be attenuated, and the high-pass filter is used.

For color misregistration correction, a plurality of latent image marks are formed on the photosensitive member 22 at a predetermined period (frequency), as will be described later. In color misregistration amount correction control, the plurality of latent image marks need to be detected by the variation in the current flowing to the current detection circuit 50. Let Vd' be the voltage variation range of the detected voltage 56 at a one-rotation period Td of the photosensitive member 22 when no latent image marks are formed, and Vp' be the voltage variation range of the detected voltage 56 at a period Tp of electrostatic latent image formation. If Vd' is larger than Vp', the latent image marks cannot properly be detected even when the detected voltage 56 varies due to the latent image marks, as shown in FIG. 4B. For this reason, the high-pass filter needs to be formed such that a voltage variation range Vd, at the one-rotation period Td of the photosensitive member 22, of the detected voltage 562 that is the output signal of the high-pass filter and a voltage variation range Vp at the electrostatic latent image formation period Tp satisfies $$Vd<Vp \tag{1}$$

That is, the rotation frequency of the photosensitive member 22 is defined as Fd=1/Td, and a correction latent image formation frequency Fp is defined as 1/Tp that is the reciprocal of the formation period Tp. In this case, the variation amount of the output signal of the high-pass filter at the frequency Fd is made smaller than the variation amount at the frequency Fp.

Figure 4C:
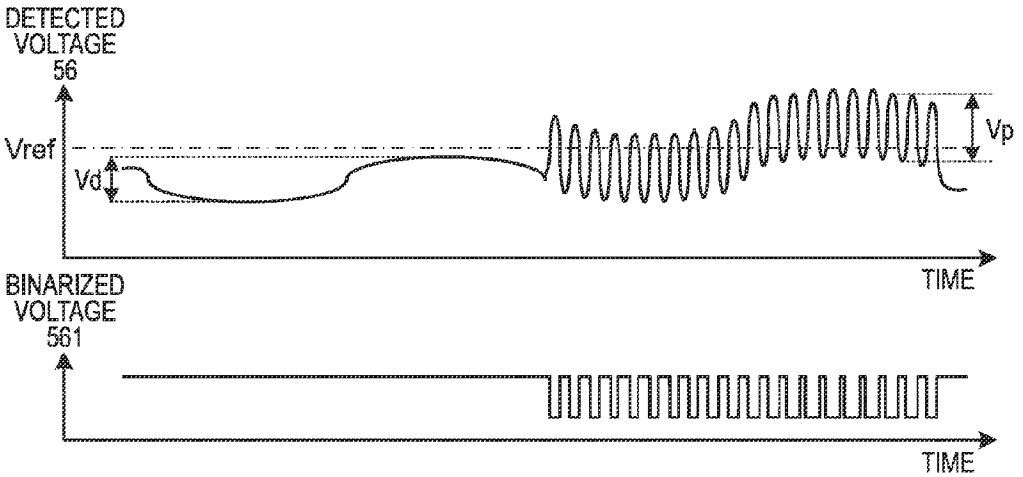

For example, when Td=500 msec, Tp=13 msec, Vd=0.8 V, and Vp=0.6 V, inequality (1) can sufficiently be satisfied by setting the capacitor 79 to 0.47 μF and the resistor 81 to 10 kΩ. This allows to properly detect each latent image mark by the binarized voltage 561 output from the comparator 74, as shown in FIG. 4C. Note that since the plurality of electrostatic latent images are formed during one rotation of the photosensitive member 22, Td is larger than Tp. Let Ad be the attenuation factor for the voltage variation at the frequency Fd (Hz) of the high-pass filter, and Ap be the attenuation factor for the voltage variation at the frequency Fp (Hz). In this case, to satisfy inequality (1), the attenuation factor for the voltage variation range Vd at the period Td needs to be large. Hence, the high-pass filter is preferably formed to satisfy $$Ap<Ad \tag{2}$$

In addition, the engine control unit 54 may control the rotation frequency of the photosensitive member 22 or the latent image mark formation period such that inequality (2) is satisfied.

For example, the resistor 81 is set to 10 kΩ, and the resistor 82 is set to 100 kΩ. The voltage variation at the one-rotation period of the photosensitive member 22 is thus removed from the output voltage of the operational amplifier 78. In addition, the difference from the voltage generated by causing the resistors 83 and 84 to divide a predetermined voltage is inverted and amplified, and output from the operational amplifier 85 as the detected voltage 562. The detected voltage 562 that is the output voltage of the operational amplifier 85 is input to the negative input terminal of the comparator 74. Since the high-pass filter has removed the voltage variation at the one-rotation period of the photosensitive member 22, the reference voltage 75 of the positive input terminal of the comparator 74 can uniquely be decided. The output voltage of the operational amplifier 78 is amplified to enable to detect a pulse by the binarized voltage 561 even when the reference voltage 75 varies due to a variation in the resistors 86 and 87. If the output voltage of the operational amplifier 78 is not amplified, the pulse cannot be detected by the binarized voltage 561, as shown in FIG. 4B, because of a variation in the reference voltage 75. In addition, since the detected voltage 562 does not vary in accordance with the one-rotation period of the photosensitive member 22, the leading edge and the trailing edge of the binarized voltage 561 can correctly be detected at the time of latent image mark detection without any influence of the voltage variation at the one-rotation period of the photosensitive member 22. As a result, the color misregistration amount can accurately be detected.

Referring back to FIG. 3, the engine control unit 54 will be explained. The engine control unit 54 comprehensively controls the operation of the image forming apparatus described with reference to FIG. 1. Using a RAM 323 as a main memory and a work area, a CPU 321 controls the respective units of the image forming apparatus in accordance with various kinds of control programs stored in an EEPROM 324. An ASIC 322 performs, for example, control of each motor and control of the high-voltage power supply of the developing bias in each printing sequence based on an instruction of the CPU 321. Note that some or all of the functions of the CPU 321 may be executed by the ASIC 322, or conversely, some or all of the functions of the ASIC 322 may be executed by the CPU 321. Some of the functions of the engine control unit 54 may be executed by other hardware.

Figure 5:
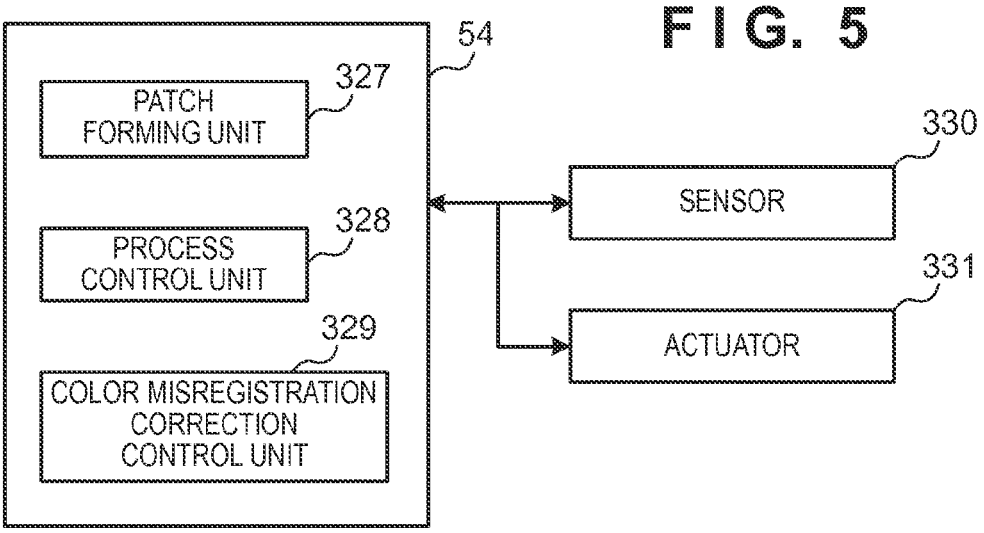
FIG. 5 is a block diagram for explaining the operation of an engine control unit.

The operation of the engine control unit 54 will be explained next with reference to FIG. 5. An actuator 331 shown in FIG. 5 generically represents actuators such as the driving motor of the photosensitive member 22 and the separation motor of the developing device 25. A sensor 330 shown in FIG. 5 generically represents sensors such as a registration sensor and the current detection circuit 50. The engine control unit 54 performs various kinds of processing based on information acquired from the sensor 330. The actuator 331 functions as, for example, a driving source for driving a cam to separate the developing sleeve 24 to be described later.

A patch forming unit 327 controls the scanner unit 20 to form latent image marks to be described later on each photosensitive member 22. The patch forming unit 327 also performs processing of forming color misregistration correction toner images to be described later on the intermediate transfer belt 30. A process control unit 328 controls the operation and settings of each process unit at the time of latent image mark detection, as will be described later. A color misregistration correction control unit 329 calculates a color misregistration correction amount from a timing detected by the binarized voltage 561 using a calculation method to be described later, and reflects the color misregistration correction amount.

The outline of color misregistration correction control according to the present embodiment will be described below. First, the engine control unit 54 forms color misregistration detection marks of toner images on the intermediate transfer belt 30, and determines the color misregistration amount by detecting the positions of the respective colors relative to a reference color by the detection sensor 40. The engine control unit 54 adjusts the image forming conditions, for example, the timing at which the scanner unit 20 irradiates the photosensitive member 22 with a laser beam so as to decrease the determined color misregistration amount.

In a state in which the color misregistration amount after the color misregistration correction using the color misregistration detection marks is small, the photosensitive member 22 acquires a reference value for color misregistration correction using latent image marks. More specifically, a plurality of latent image marks are formed on each photosensitive member 22. The reference value is obtained by determining, based on the detected voltage 562, the time at which the formed latent image marks reach the position of the charging roller 23. In color misregistration correction control performed after that when, for example, the temperature in the apparatus has risen due to continuous printing or the like, color misregistration is corrected by determining the color misregistration amount based on the reference value and formed latent image marks. Note that the color misregistration correction is assumed hereinafter to be done by controlling the laser beam irradiation timing. However, for example, the speed of the photosensitive member 22 or the mechanical position of a reflecting mirror included in the scanner unit 20 may be controlled. Details of the color misregistration correction control will be described below with reference to FIG. 6.

Figure 6:
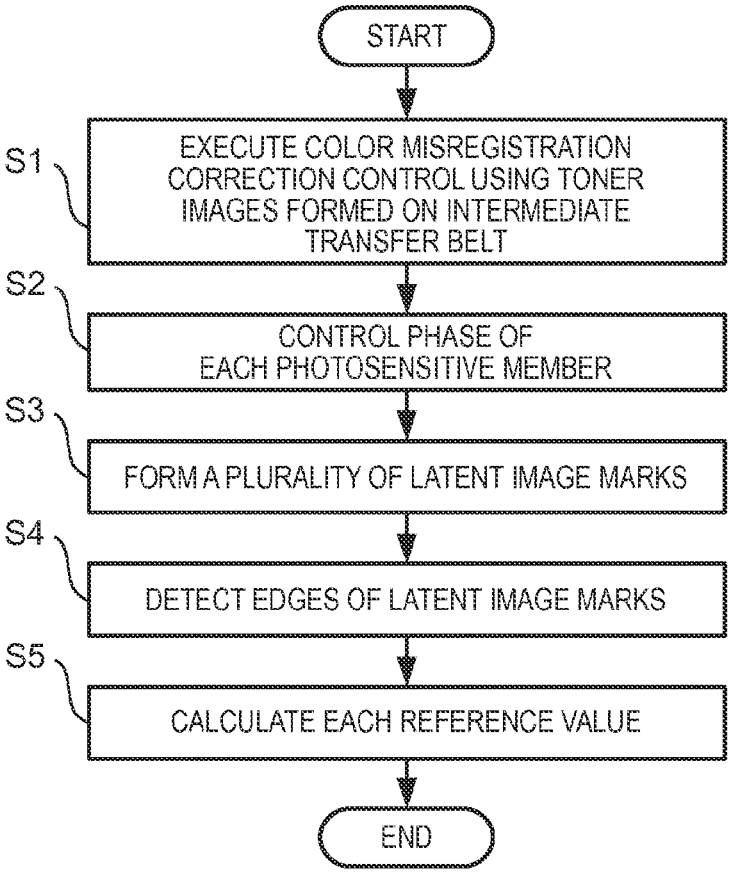
FIG. 6 is a flowchart of reference value calculation processing according to an embodiment.
Figure 7A:
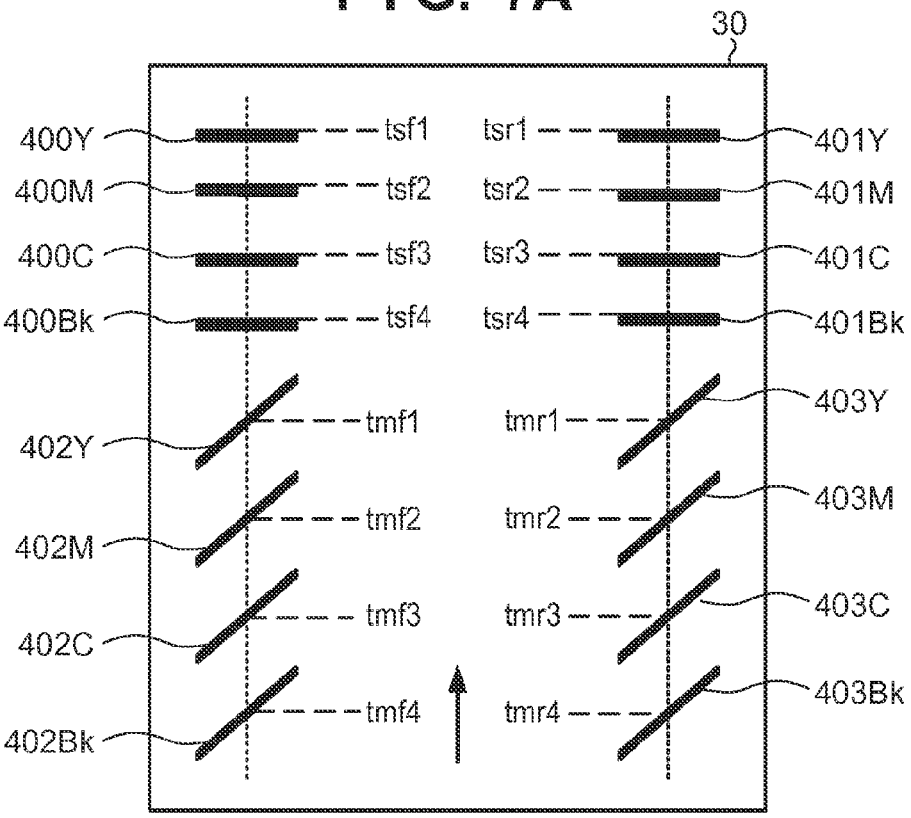
FIG. 7A is a view showing color misregistration detection marks according to an embodiment.

In step S1 of FIG. 6, the engine control unit 54 causes each image forming station to form color misregistration detection toner image marks on the intermediate transfer belt 30. FIG. 7A shows examples of the color misregistration detection marks. Referring to FIG. 7A, marks 400 and 401 are patterns used to detect the color misregistration amount in the sheet conveyance direction (sub-scanning direction). Marks 402 and 403 are patterns used to detect the color misregistration amount in the main scanning direction perpendicular to the sheet conveyance direction. Note that the arrow in FIG. 7A indicates the moving direction of the intermediate transfer belt 30, and corresponds to the sub-scanning direction. In the example shown in FIG. 7A, the marks 402 and 403 tilt by 45° with respect to the main scanning direction. Note that characters Y, M, C, and Bk added to the reference numerals of the marks 400 to 403 as suffixes indicate that the corresponding marks are formed by yellow, magenta, cyan, and black toners, respectively. In addition, tsf1 to tsf4, tmf1 to tmf4, tsr1 to tsr4, and tmr1 to tmr4 of the marks represent the timings of detection by the detection sensor 40. Note that detection of these marks by the detection sensor 40 can be done using a known technique of, for example, detecting reflected light when irradiating the marks with light.

Yellow is set as the reference color, and correction of the position of magenta will representatively be explained below. This also applies to correction of the remaining positions of cyan and black. Let v (mm/s) be the moving speed of the intermediate transfer belt 30, and dsM be the theoretical distance between the marks 400 and 401 of yellow and the marks 400 and 401 of magenta. In this case, a color misregistration amount δesM of magenta in the sub-scanning direction is given by $$\delta esM = v \times \{(tsf2 - tsf1) + (tsr2 - tsr1)\}/2 - dsM$$

Concerning the main scanning direction, for example, a color misregistration amount δemfM of magenta on the left side is given by $$\delta emfM = v \times (tmf2 - tsf2) - v \times (tmf1 - tsf1)$$

This also applies to a color misregistration amount δemrM of magenta on the right side. The positive/negative sign of δemfM and δemrM represents the direction of misalignment in the main scanning direction. The engine control unit 54 corrects the magenta color write position from δemfM, and corrects the width in the main scanning direction, that is, the main scanning magnification from δemrM−δemfM. Note that if the main scanning magnification contains an error, the write position is calculated in consideration of not only δemfM but also the change amount of an image frequency (image clock) that has changed in accordance with correction of the main scanning magnification. The engine control unit 54 changes, for example, the timing of laser beam emission by the scanner unit 20 so as to eliminate the calculated color misregistration amount. For example, if the color misregistration amount in the sub-scanning direction corresponds to −4 lines, the engine control unit 54 controls to advance the timing of emission of the laser beam to form the electrostatic latent images of magenta by +4 lines. That is, the processing in step S1 enables to perform subsequent reference value acquisition processing in a state in which the color misregistration amount is small.

Referring back to FIG. 6, in step S2, the engine control unit 54 adjusts the rotation phase of each photosensitive member 22 to a predetermined state to suppress the influence of a variation in the rotation speed (outer surface speed) of the photosensitive member 22. More specifically, the adjustment is performed under the control of the engine control unit 54 such that the phase of the photosensitive member 22 of the reference color and those of the photosensitive members 22 of the remaining colors hold a predetermined relationship. If, for example, the driving gear of the photosensitive member 22 is provided in the rotating shaft of the photosensitive member 22, the adjustment is performed such that the driving gears of the photosensitive members 22 hold a predetermined phase relationship.

The engine control unit 54 adjusts the phase of each photosensitive member 22 in step S2, and after that, forms a predetermined number of, in this case, 20 latent image marks on each photosensitive member 22 in step S3. Note that when forming the plurality of latent image marks, the developing sleeve 24 is separated from the photosensitive member 22 not to develop the toner images, and the primary transfer roller 26 is also separated from the photosensitive member 22. Note that as for the primary transfer roller 26, the applied voltage may be set to off (zero) to make the action on the photosensitive member 22 smaller than in normal image formation. As for the developing sleeve 24, a bias voltage of a polarity opposite to that in the normal state may be applied not to apply the toner. In addition, when a jumping developing method is used in which the photosensitive member 22 and the developing sleeve 24 are set in a noncontact state, and a voltage is applied by superimposing an AC bias on a DC bias, turning off voltage application to the developing sleeve 24 suffices.

Figure 7B:
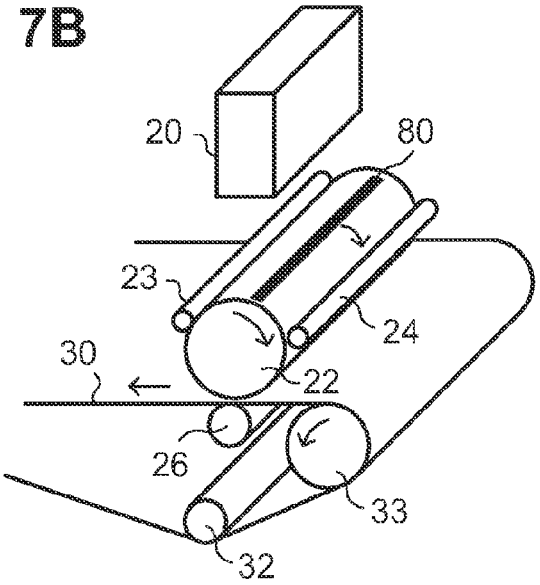
FIG. 7B is a view showing a latent image mark according to an embodiment.

FIG. 7B shows a state in which a latent image mark 80 is formed on the photosensitive member 22. The latent image mark 80 is formed to have, for example, the maximum width over the image region in the main scanning direction and a width corresponding to about 30 scanning lines in the sub-scanning direction. Note that concerning the main scanning direction, the latent image mark 80 can be formed to have a width ½ or more of the maximum width of the image region to increase the variation range of the detected voltage 56 by the latent image mark 80. In addition, the width of the latent image mark 80 can be increased up to a region outside the outer region of the image region (the printing region on the printing medium).

Figure 8A:
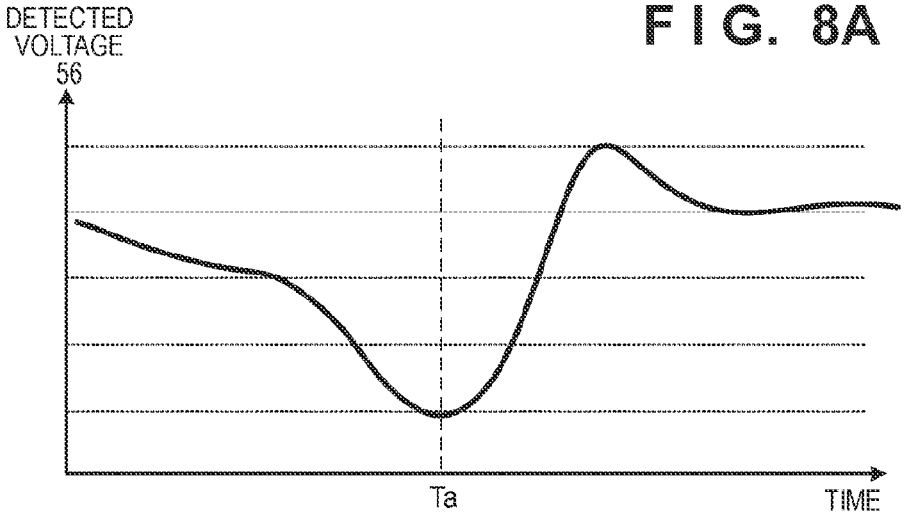
FIGS. 8A to 8C are explanatory views of latent image mark detection.
Figure 8B:
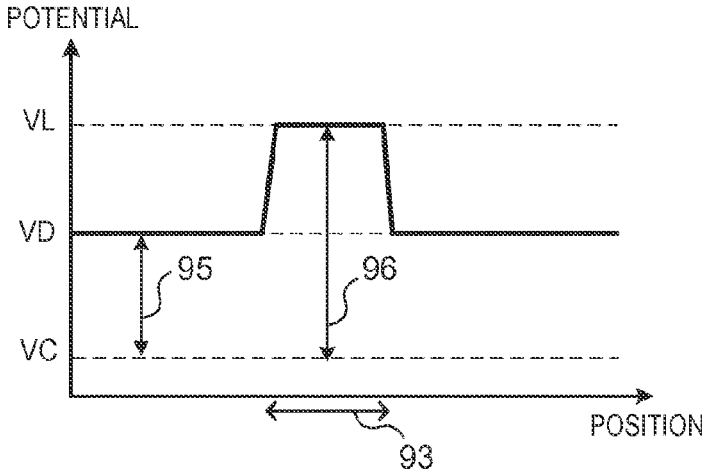
Figure 8C:
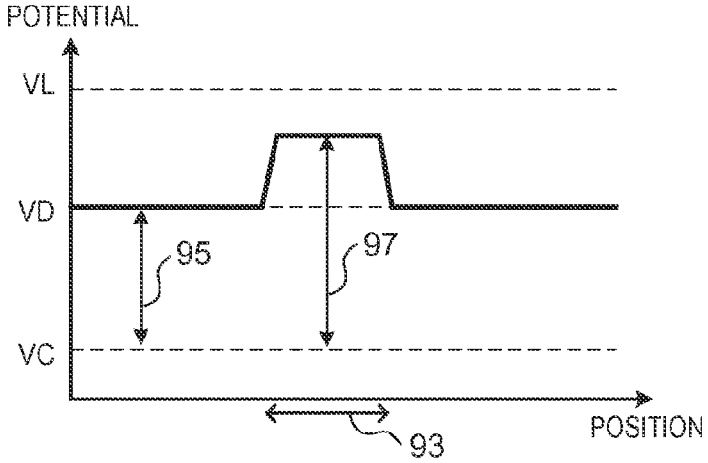

In step S4, the engine control unit 54 detects each edge of each latent image mark 80 formed on each photosensitive member 22 based on the detected voltage 562. FIG. 8A shows a time variation in the detected voltage 56 when the latent image mark 80 has reached the charging roller 23. As shown in FIG. 8A, when the latent image mark 80 passes through a position facing the charging roller 23, the detected voltage 56 temporarily lowers accordingly and then changes to return. The reason why the detected voltage 56 changes as shown in FIG. 8A will be described. FIGS. 8B and 8C show the surface potential of the photosensitive member 22 when the toner is not adhered to the latent image mark 80 and that when the toner is adhered, respectively. Note that in these graphs, the abscissa represents the surface position of the photosensitive member 22 in the conveyance direction, and a region 93 indicates the position where the latent image mark 80 is formed. The ordinate represents the potential. Let VD be the dark potential (for example, −700 V) of the photosensitive member 22, VL be the bright potential (for example, −100 V), and VC be the charging bias potential (for example, −1000 V) of the charging roller 23.

In the region 93 of the latent image mark 80, potential differences 96 and 97 between the charging roller 23 and the photosensitive member 22 are larger than a potential difference 95 in the remaining region. For this reason, when the latent image mark 80 reaches the charging roller 23, the value of the current flowing to the charging roller 23 increases. Along with the increase in the current, the voltage value of the output terminal of the operational amplifier 70 decreases. This is the reason why the detected voltage 56 lowers. As described above, the detected voltage 56 reflects the surface potential of the photosensitive member 22. Note that the current between the charging roller 23 and the photosensitive member 22 is supposed to flow via the nip portion between the charging roller 23 and the photosensitive member 22, by discharge near the nip portion, or by both of them, and the form does not matter.

The detected voltage 56 temporarily decreases by the latent image mark 80 and then returns to the original value. Hence, the comparator 74 shown in FIG. 3 outputs two, leading and trailing edges at the time of passage of one latent image mark 80. Hence, for example, when 20 latent image marks 80 are formed for each color, the engine control unit 54 detects 40 edges for each color. Note that the engine control unit 54 stores detection times ty(k), tm(k), tc(k), and tbk(k) of the edges of yellow, magenta, cyan, and black in the RAM 323.

In step S5, the engine control unit 54 calculates reference values esYM, esYC, and esYBk of magenta, cyan, and black based on yellow by $$esYM = \sum_{k=1}^{20} (tm(2k-1) + tm(2k))/2 - \sum_{k=1}^{20} (ty(2k-1) + ty(2k))/2$$

$$esYC = \sum_{k=1}^{20} (tc(2k-1) + tc(2k))/2 - \sum_{k=1}^{20} (ty(2k-1) + ty(2k))/2$$

$$esYBk = \sum_{k=1}^{20} (tbk(2k-1) + tbk(2k))/2 - \sum_{k=1}^{20} (ty(2k-1) + ty(2k))/2$$

Each reference value is the difference between the average value of the detection times of the center between two edges detected by each latent image mark 80 of a corresponding color and the average value of the detection times of the center between two edges detected by each latent image mark 80 of yellow that is the reference color. Note that the reference values can be calculated either by the CPU 321 based on a program or using a hardware circuit or a table. The engine control unit 54 stores each calculated reference value in the EEPROM 324 as data representing the color misregistration amount in which the component of the rotation period of the photosensitive member 22 has been canceled.

Figure 9:
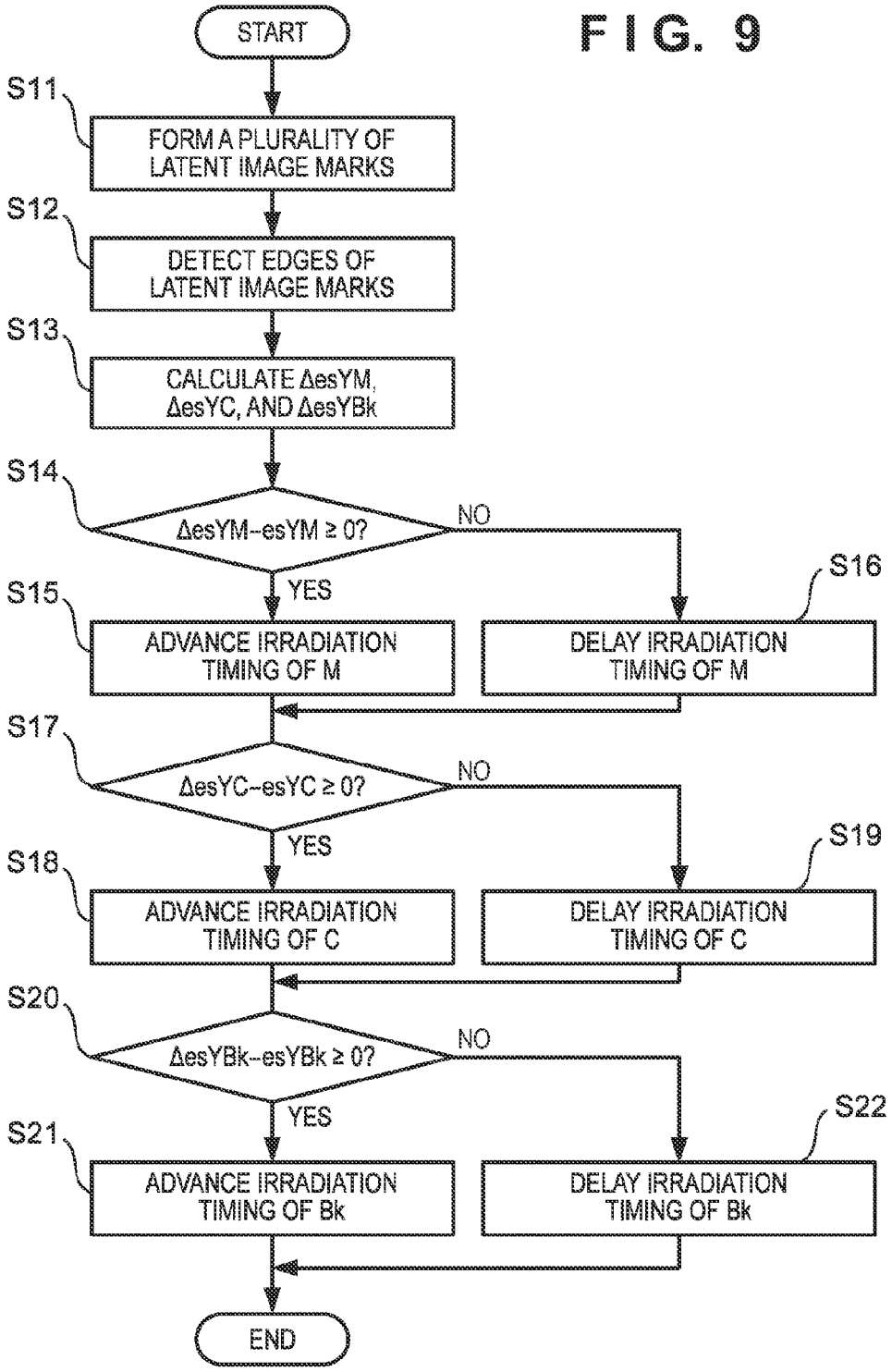
FIG. 9 is a flowchart of color misregistration correction control according to an embodiment.

Color misregistration correction control according to the present embodiment will be described next with reference to FIG. 9. In step S11, the engine control unit 54 forms, on each photosensitive member 22, the latent image marks 80 as many as those formed at the time of reference value acquisition described with reference to FIG. 6. In step S12, the engine control unit 54 detects the latent image marks 80 on each photosensitive member 22 and stores the detection times in the RAM 323. After that, in step S13, the engine control unit 54 calculates ΔesYM, ΔesYC, and ΔesYBk by $$\Delta esYM = \sum_{i=1}^{20} (tm(2i-1) + tm(2i))/2 - \sum_{i=1}^{20} (ty(2i-1) + ty(2i))/2$$

$$\Delta esYC = \sum_{i=1}^{20} (tc(2i-1) + tc(2i))/2 - \sum_{i=1}^{20} (ty(2i-1) + ty(2i))/2$$

$$\Delta esYBk = \sum_{i=1}^{20} (tbk(2i-1) + tbk(2i))/2 - \sum_{i=1}^{20} (ty(2i-1) + ty(2i))/2$$

and stores them in the RAM 323.

In step S14, the engine control unit 54 determines whether the difference between ΔesYM and the reference value esYM of magenta is 0 or more. When the difference is 0 or more, this indicates that the detection timing of magenta delays with respect to yellow. Hence, in step S15, the engine control unit 54 advances the irradiation timing of the laser beam corresponding to magenta. Note that the amount to be advanced can be specified by the difference value. On the other hand, when the difference is smaller than 0, this indicates that the detection timing of magenta advances with respect to yellow. Hence, in step S16, the engine control unit 54 delays the irradiation timing of the laser beam corresponding to magenta. This allows to suppress the color misregistration amount between yellow and magenta. At this time, laser emission is done on the line basis. Hence, the difference is converted on the line basis, and the laser light emission timing is controlled to minimize the color misregistration amount. The engine control unit 54 performs the same processing as described above for cyan in steps S17 to S19, and performs the same processing as described above for black in steps S20 to S22. The color misregistration state at that time can be returned to the reference state in this way.

In the above-described embodiment, the positions of the colors relative to the reference color are corrected. However, the respective colors may be controlled independently, as will be described below. A modification for controlling the respective colors independently will be described below. Note that the engine control unit 54 executes the procedure to be described below independently for the respective colors. In this modification, in step S4 of FIG. 6, a detection time t(k) of each edge of the latent image mark 80 is detected and stored. In step S5, a reference value es of each color is calculated by $$es = \sum_{k=1}^{20} (t(2k-1) + t(2k))/2$$

The reference value es is the average value of the detection times of the center of the latent image marks 80 of a corresponding color.

Figure 10:
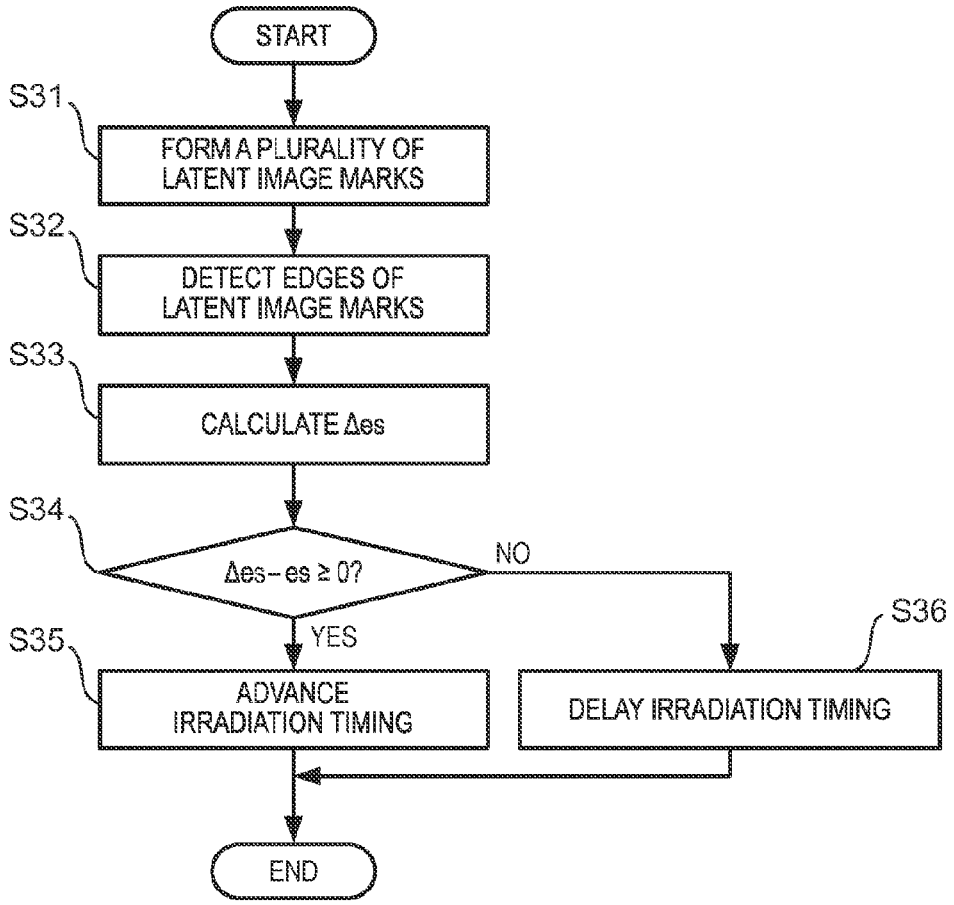
FIG. 10 is a flowchart of color misregistration correction control according to an embodiment.

Color misregistration correction control according to this modification will be described next with reference to FIG. 10. In step S31, the engine control unit 54 forms, on each photosensitive member 22, the latent image marks 80 as many as those formed at the time of reference value acquisition. In step S32, the engine control unit 54 detects the latent image marks 80 on each photosensitive member 22 and stores the detection times in the RAM 323. After that, in step S33, the engine control unit 54 calculates Δes of each color by $$\Delta es = \sum_{i=1}^{20} (t(2i-1) + t(2i))/2$$

and stores it in the RAM 323.

In step S34, the engine control unit 54 determines, for each color, whether the difference between Δes and the reference value es is 0 or more. When the difference is 0 or more, this indicates that the detection timing of the corresponding color delays. Hence, in step S35, the engine control unit 54 advances the irradiation timing of the laser beam of the corresponding color. Note that the amount to be advanced can be specified by the difference value. On the other hand, when the difference is smaller than 0, this indicates that the detection timing of the latent image mark 80 of the corresponding color advances. Hence, in step S36, the engine control unit 54 delays the irradiation timing of the corresponding laser beam. This allows to return the color misregistration amount to the reference state.

In this embodiment, charging rollers 23*a* to 23*d* are provided with charging high-voltage power supply circuits 43*a* to 43*d*, respectively. Each of the charging high-voltage power supply circuits 43*a* to 43*d* is provided with the current detection circuit 50. However, the charging rollers 23*a* to 23*d* may be provided with one common current detection circuit 50, as will be described below.

Figure 11:
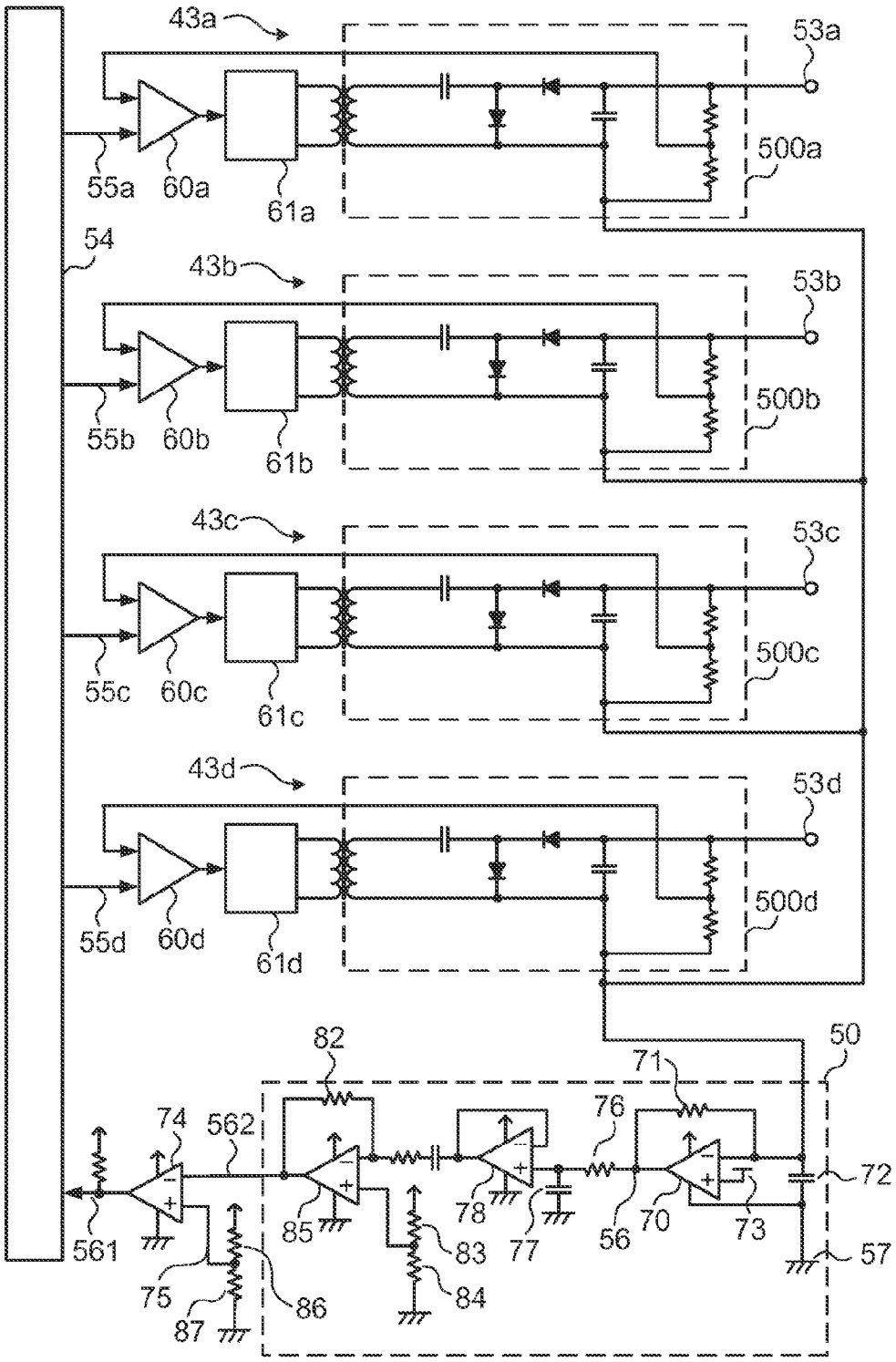
FIG. 11 is a circuit diagram showing an arrangement for detecting a latent image mark according to an embodiment.

FIG. 11 shows a circuit arrangement including the charging high-voltage power supply circuits 43*a* to 43*d*, and the current detection circuit 50 common to the charging high-voltage power supply circuits 43*a* to 43*d*. Note that the reference numerals of the constituent elements in secondary-side circuits 500*a* to 500*d* of the charging high-voltage power supply circuits 43*a* to 43*d* are omitted for the sake of simplicity. Referring to FIG. 10, the engine control unit 54 controls driving circuits 61*a* to 61*d* based on voltage set values 55*a* to 55*d* set for operational amplifiers 60*a* to 60*d*, and outputs desired voltages to outputs 53*a* to 53*d*. A current output from each of the charging high-voltage power supply circuits 43*a* to 43*d* flows to the current detection circuit 50 via a corresponding photosensitive member and charging roller 23 and the ground point 57. Hence, a voltage corresponding to a value obtained by superimposing the currents of the output terminals 53*a* to 53*d* appears as the detected voltage 56.

Figure 3:
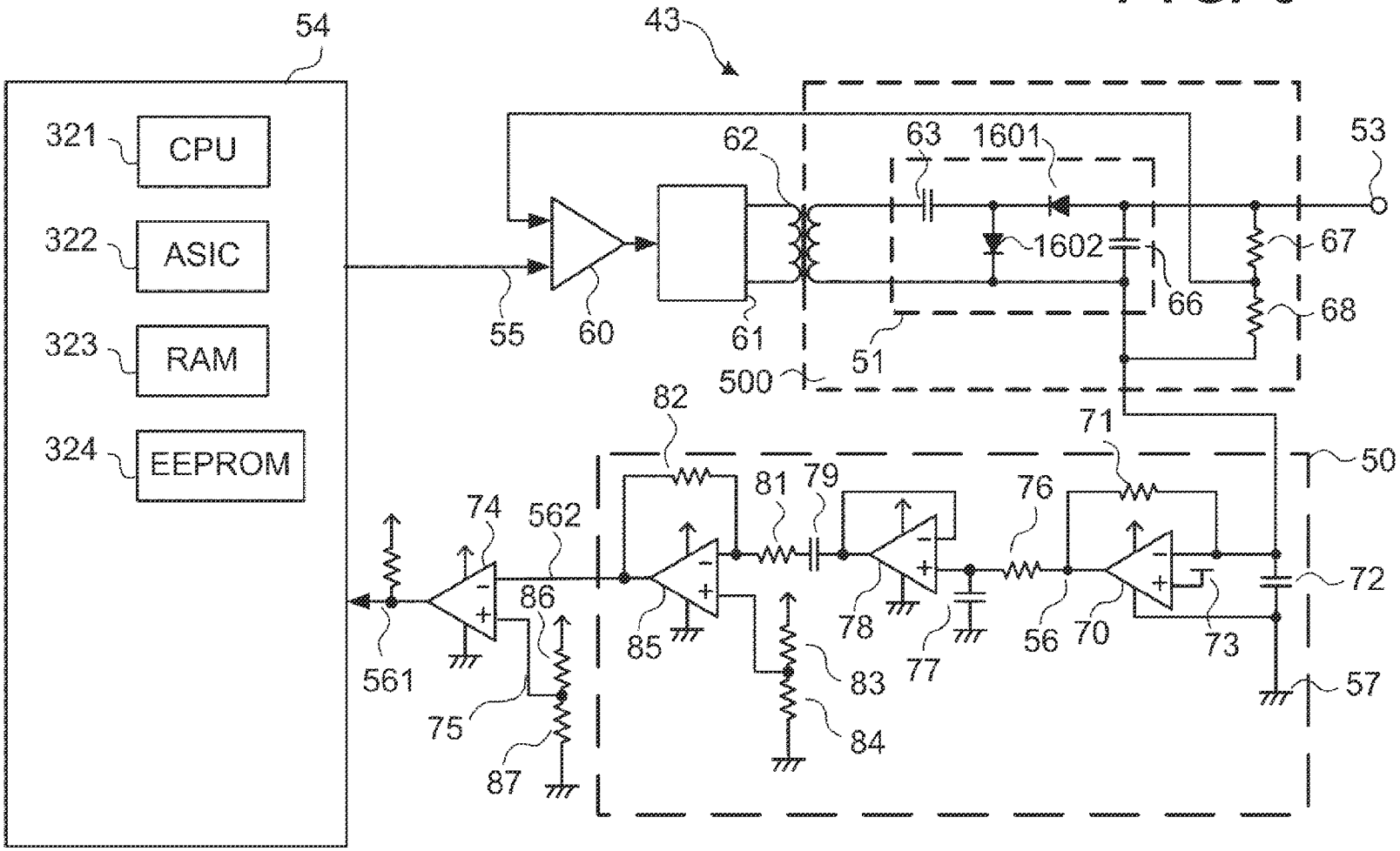
FIG. 3 is a circuit diagram showing an arrangement for detecting a latent image mark according to an embodiment.

Note that the arrangement of the current detection circuit 50, the arrangement concerning the comparator 74, and the arrangement of the engine control unit 54 are the same as in FIG. 3, and a description thereof will be omitted. Note that the noninverting input terminal of the operational amplifier 70 is virtually grounded to the reference voltage 75 and set to a predetermined voltage. Hence, the voltage of the noninverting input terminal of the operational amplifier 70 never varies due to the operation of the charging high-voltage power supply circuit of a color and affects the operation of the charging high-voltage power supply circuit of another color. In other words, the plurality of charging high-voltage power supply circuits 43*a* to 43*d* operate like the charging high-voltage power supply circuit 43 shown in FIG. 2 without affecting each other.

Color misregistration correction control in the arrangement described with reference to FIG. 11 will be explained below with reference to the timing chart of FIG. 12. At time T1, the engine control unit 54 outputs a driving signal to drive the cam for separating developing sleeves 24*a* to 24*d*. At timing T2, the developing sleeves 24*a* to 24*d* operate so as to change from a state in which they are in contact with photosensitive members 22*a* to 22*d* to a state in which the developing sleeves are separated from the photosensitive members. At time T3, the engine control unit 54 controls the primary transfer bias from the on state to the off state.

Figure 12:
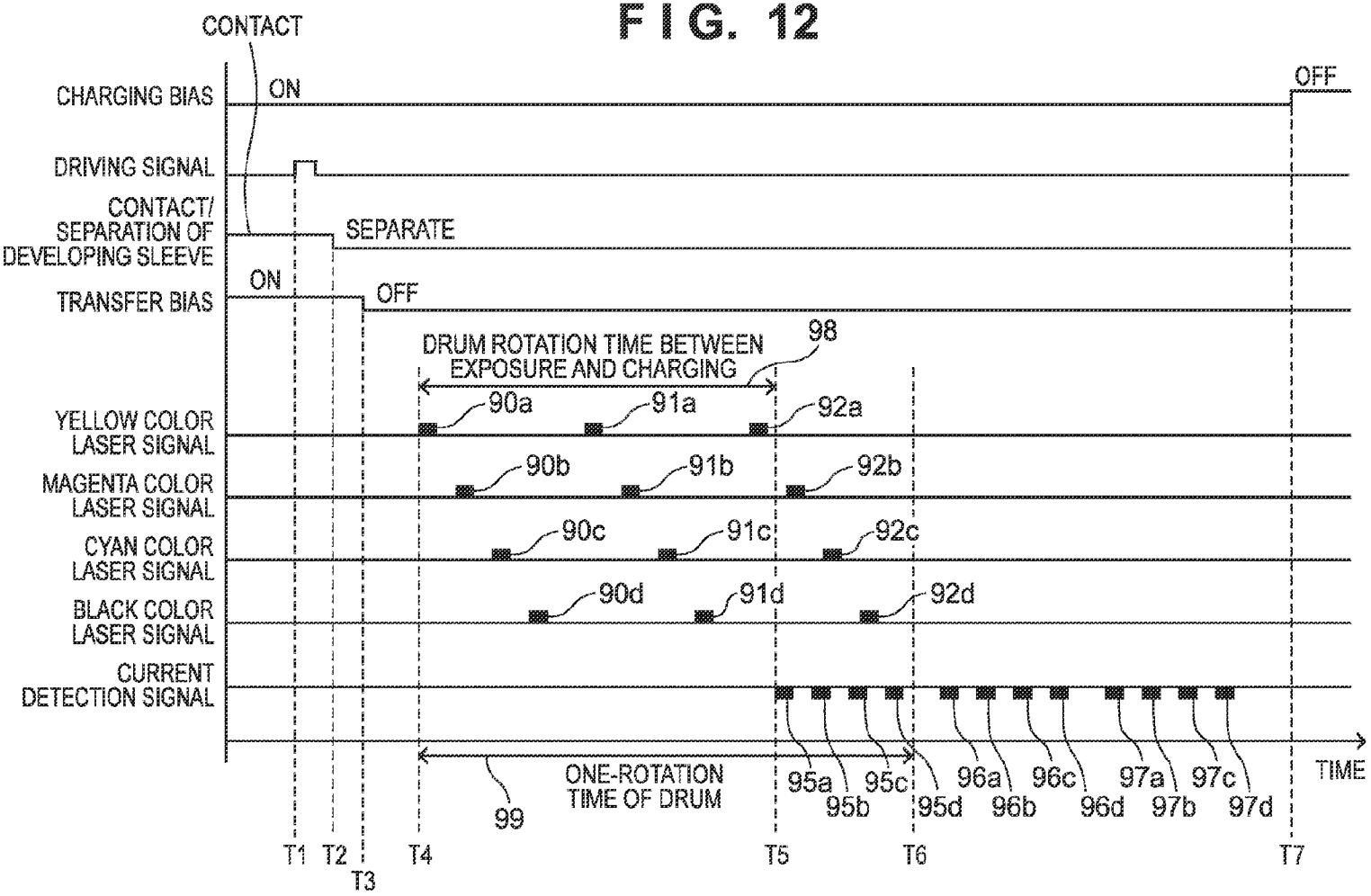
FIG. 12 is a timing chart of color misregistration correction control according to an embodiment.

During a period of times T4 to T6 in FIG. 12, the latent image marks 80 for the color misregistration are formed, on the photosensitive member of each color, at a period of about ⅓ of the photosensitive member 22. In FIG. 12, the latent image marks 80 are formed in the order of laser signals 90*a*, 90*b*, 90*c*, 90*d*, 91*a*, 91*b*, 91*c*, 91*d*, 92*a*, 92*b*, 92*c*, and 92*d*.

During a period of times T5 to T7 in FIG. 12, changes occur in current detection. Reference numerals 95*a* to 95*d* denote detection results of current changes by the latent image marks 80 formed by the laser signals 90*a* to 90*d*. Similarly, reference numerals 96*a* to 96*d* denote detection results of the laser signals 91*a* to 91*d*; and 97*a* to 97*d*, detection results of the laser signals 92*a* to 92*d*. The latent image marks 80 are formed not to make the detection timings overlap. This enables to apply the common current detection circuit 50 to the plurality of charging rollers 23. Note that the current detection signal in FIG. 12 corresponds to the detected voltage 56 or binarized voltage 561 described above. When current detection is done during the period of the times T5 to T7, the engine control unit 54 performs reference value calculation processing.

Note that in the arrangement described with reference to FIG. 11, the processing of the engine control unit 54 is the same as that when the arrangement shown in FIG. 3 is used except that the latent image marks 80 corresponding to the respective colors are sequentially detected. That is, reference value calculation and color misregistration correction control processing are the same as those described with reference to FIGS. 6, 9, and 10.

As described above, when the output signal obtained upon detecting the latent image marks 80 used at the time of color misregistration correction control is converted by the high-pass filter, the voltage variation range Vp of the latent image mark formation period Tp can appropriately be controlled, and the latent image marks 80 can accurately be detected. In addition, since the latent image marks 80 can accurately be detected, the position shift of an image can also accurately be corrected.

Second Embodiment

Figure 13:
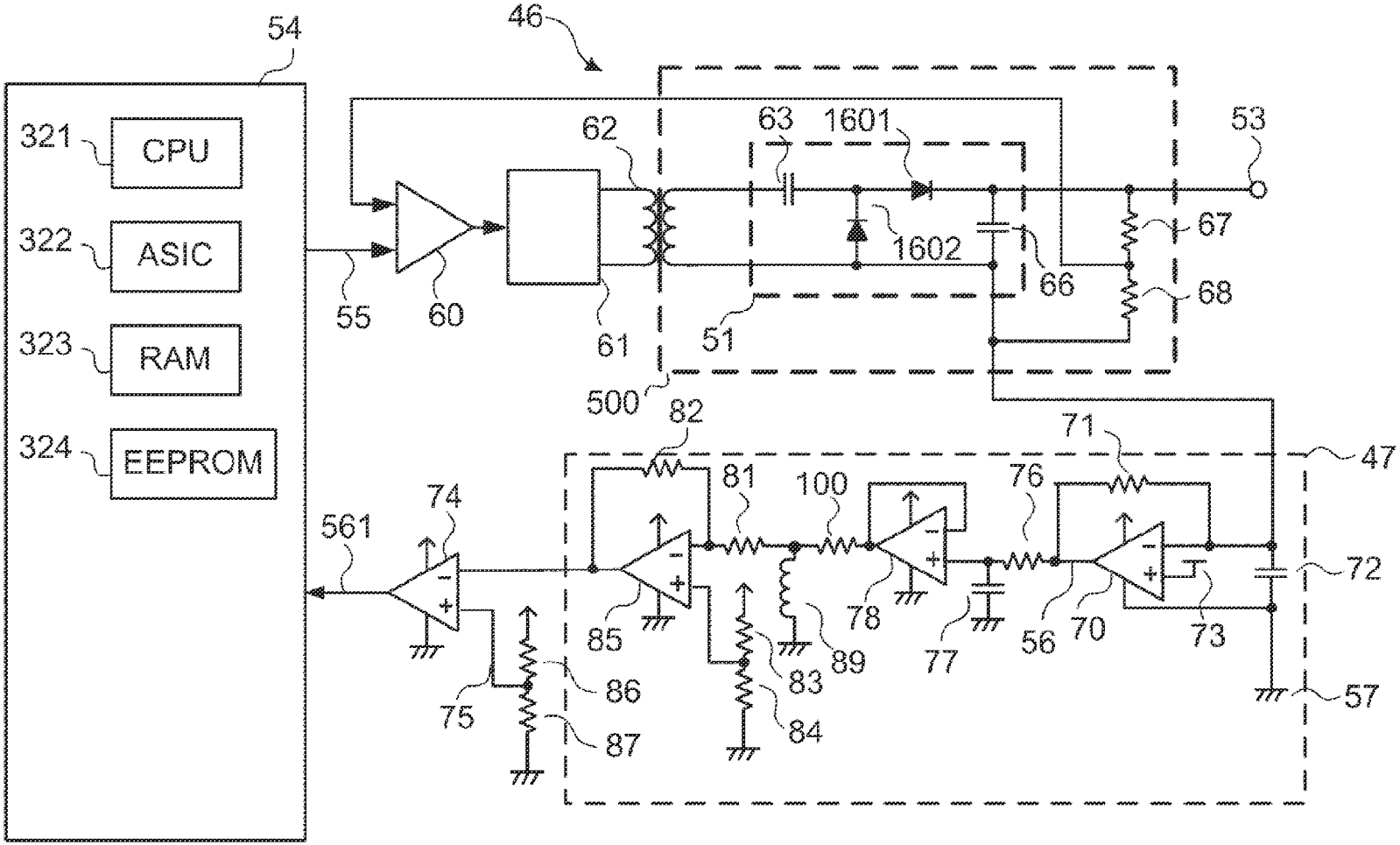
FIG. 13 is a circuit diagram showing an arrangement for detecting a latent image mark according to an embodiment.

In the second embodiment, points of difference from the first embodiment will mainly be described next. In the first embodiment, the current flowing via the charging high-voltage power supply circuit 43 and the charging roller 23 is detected to detect the latent image marks 80. In the second embodiment, latent image marks 80 are detected by a current that flows via a primary transfer high-voltage power supply circuit 46 and a primary transfer roller 26. FIG. 13 shows an arrangement for detecting the latent image marks 80 according to the present embodiment. The arrangement shown in FIG. 13 is different from that shown in FIG. 3 in that diodes 1601 and 1602 are directed in opposite directions. This is because an output terminal 53 should output a transfer bias of, for example, +1000 V.

In a current detection circuit 47 according to the present embodiment, a high-pass filter is formed from a resistor 100 and a coil 89 that is an inductive element. However, the high-pass filter may be formed using a capacitor 79 that is a capacitive element, as in the first embodiment. Alternatively, the arrangement shown in FIG. 13 may be applied to the high-pass filter of the first embodiment.

Reference value acquisition and color misregistration correction by the latent image marks 80 are the same as in the first embodiment except that the current that flows via the primary transfer high-voltage power supply circuit 46 and the primary transfer roller 26 is used, and a description thereof will be omitted. Note that since the latent image marks 80 are detected using the current that flows via the primary transfer high-voltage power supply circuit 46 and the primary transfer roller 26, the primary transfer roller 26 contacts with a photosensitive member 22 to apply the transfer bias in detection processing of the latent image marks 80, as a matter of course. In FIG. 13, each primary transfer high-voltage power supply circuit 46 is provided with the current detection circuit 47. However, the plurality of primary transfer high-voltage power supply circuits 46 may be provided with a common current detection circuit 47, as in the arrangement shown in FIG. 11.

As described above, even when detecting the latent image marks 80 using the current that flows via the primary transfer high-voltage power supply circuit 46 and the primary transfer roller 26, the signal output upon detecting the latent image marks 80 to be used for color misregistration correction control is converted by the high-pass filter. This allows to appropriately control a voltage variation range Vp of a latent image mark formation period Tp and accurately detect the latent image marks 80. In addition, since the latent image marks 80 can accurately be detected, the position shift of an image can also accurately be corrected.

Third Embodiment

Figure 14:
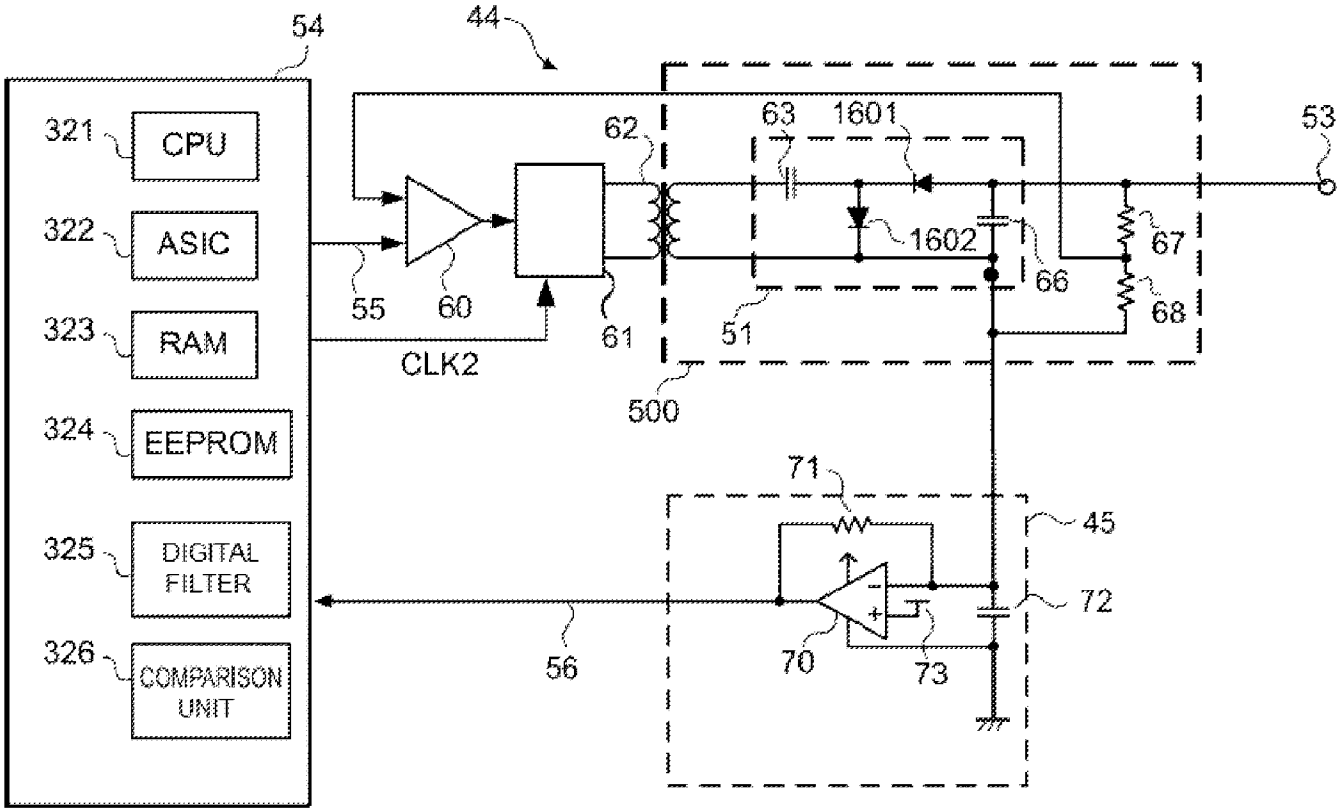
FIG. 14 is a circuit diagram showing an arrangement for detecting a latent image mark according to an embodiment.

In the third embodiment, points of difference from the first embodiment will mainly be described next. In the first embodiment, the current flowing via the charging high-voltage power supply circuit 43 and the charging roller 23 is detected to detect the latent image marks 80. In the third embodiment, latent image marks 80 are detected by a current that flows via a developing high-voltage power supply circuit 44 and a developing sleeve 24. FIG. 14 shows an arrangement for detecting the latent image marks 80 according to the present embodiment. The arrangement shown in FIG. 14 is different from that shown in FIG. 3 in that the output of an operational amplifier 70 is directly input to an engine control unit 54, and the engine control unit 54 is provided with a digital filter 325 and a comparison unit 326. Note that an output terminal 53 applies a developing bias of, for example, −400 V.

In the present embodiment, a detected voltage 56 input from the operational amplifier 70 to the engine control unit 54 undergoes removal of a voltage variation component of a frequency for a period Td in the digital filter 325 that is a high-pass filter. After that, the comparison unit 326 compares the reference voltage with the detected voltage 56 that has undergone the low-frequency component removal, thereby detecting the latent image marks 80. As described above, in the present embodiment, it is possible to accurately detect the color misregistration amount by removing the voltage variation component of the detected voltage 56 using the digital filter. Note that the arrangement using the digital filter 325 is also applicable to an arrangement for detecting the latent image marks 80 using a current that flows via a charging roller 23 or a primary transfer roller 26. In the present embodiment as well, the high-pass filter described in the first embodiment or the second embodiment may be used in place of the digital filter 325.

Note that the reference value acquisition in each of the above-described embodiment need not be performed in every color misregistration correction control. This is because when the temperature in the apparatus returns from a high temperature to a normal temperature, the mechanical state returns to an almost fixed state. An EEPROM 324 may store a predetermined reference value known at the stage of design or manufacturing.

As described above, even when detecting the latent image marks 80 using the current that flows via the developing high-voltage power supply circuit 44 and the developing sleeve 24, the signal output upon detecting the latent image marks 80 to be used for color misregistration correction control is converted by the high-pass filter. This allows to appropriately control a voltage variation range Vp of a latent image mark formation period Tp and accurately detect the latent image marks 80. In addition, since the latent image marks 80 can accurately be detected, the position shift of an image can also accurately be corrected.

Other Embodiments

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

a photosensitive member to be rotated;

a light irradiation unit configured to form an electrostatic latent image on the photosensitive member by irradiating with light;

a process unit configured to form an image;

a voltage or current detection unit configured to detect a voltage or current output value generated via the process unit when an electrostatic latent image for correction formed by the light irradiation unit passes through a position facing the process unit; and a control unit configured to correct a condition for forming an electrostatic latent image in image formation based on a detection result by the voltage or current detection unit, wherein a first output value and a second output value less than the first output value of detection results by the voltage or current detection unit are adjusted such that the first output value is greater than a threshold for detecting the electrostatic latent image for correction, and the second output value is less than the threshold, and wherein the first output value and the second output value are detected by the voltage or current detection unit while the output values vary in a formation period Tp of the electrostatic latent image for correction.

2. The apparatus according to claim 1, wherein the process unit comprises one of a charging unit configured to charge the photosensitive member, a developing unit configured to develop the electrostatic latent image formed on the photosensitive member to form a toner image on the photosensitive member, and a transfer unit configured to transfer the toner image formed on the photosensitive member to one of a printing medium and an image carrier.

3. The apparatus according to claim 1, wherein the control unit is further configured to control one of a rotation frequency of the photosensitive member and a formation period of the electrostatic latent image for correction to adjust the first output value and the second output value.

4. The apparatus according to claim 1, wherein the control unit is further configured to detect a position of the electrostatic latent image for correction using the first output value, the second output value and the threshold, and control a timing at which the electrostatic latent image is formed on the photosensitive member based on the detected position.

5. The apparatus according to claim 4, wherein the photosensitive member is provided in correspondence with each of a plurality of colors used in image formation, and the control unit is further configured to detect a shift of a position of the electrostatic latent image for correction formed on a photosensitive member corresponding to another color with respect to a position of the electrostatic latent image for correction formed on a photosensitive member corresponding to a reference color from a reference value, thereby controlling a timing at which the electrostatic latent image is formed on the photosensitive member corresponding to the other color.

6. The apparatus according to claim 4, wherein the photosensitive member is provided in correspondence with each of a plurality of colors used in image formation, and the control unit is further configured to independently control a timing at which the electrostatic latent image is formed on the photosensitive member corresponding to each color.

7. The apparatus according to claim 1, wherein the voltage or current detection unit is provided in correspondence with each of a plurality of colors used in image formation.

8. The apparatus according to claim 1, further comprising a voltage application unit configured to apply a voltage to the process unit, wherein the voltage or current detection unit is further configured to detect a current that flows to the voltage application unit via the process unit when the voltage application unit applies the voltage to the process unit.

9. An image forming apparatus including a photosensitive member to be rotated and being capable of forming an electrostatic latent image for correction on the photosensitive member, the image forming apparatus comprising:

a voltage or current detection unit configured to detect a voltage or current output value based on the electrostatic latent image for correction formed on the photosensitive member; and a control unit configured to correct a condition for forming an electrostatic latent image in image formation based on a detection result by the voltage or current detection unit, wherein a first output value and a second output value less than the first output value of detection results by the voltage or current detection unit are adjusted such that the first output value is greater than a threshold for detecting the electrostatic latent image for correction and the second output value is less than the threshold, and wherein the first output value and the second output value are detected by the voltage or current detection unit while the output values vary in a formation period Tp of the electrostatic latent image for correction.

10. The apparatus according to claim 9, wherein the control unit is further configured to control one of a rotation frequency of the photosensitive member and a formation period of the electrostatic latent image for correction to adjust the first output value and the second output value.

11. The apparatus according to claim 9, wherein the control unit is further configured to detect a position of the electrostatic latent image for correction using the first output value, the second output value and the threshold, and control a timing at which the electrostatic latent image is formed on the photosensitive member based on the detected position.

12. The apparatus according to claim 11, wherein the photosensitive member is provided in correspondence with each of a plurality of colors used in image formation, and the control unit is further configured to detect a shift of a position of the electrostatic latent image for correction formed on a photosensitive member corresponding to another color with respect to a position of the electrostatic latent image for correction formed on a photosensitive member corresponding to a reference color from a reference value, thereby controlling a timing at which the electrostatic latent image is formed on the photosensitive member corresponding to the other color.

13. The apparatus according to claim 11, wherein the photosensitive member is provided in correspondence with each of a plurality of colors used in image formation, and the control unit is further configured to independently control a timing at which the electrostatic latent image is formed on the photosensitive member corresponding to each color.

14. The apparatus according to claim 9, wherein the voltage or current detection unit is provided in correspondence with each of a plurality of colors used in image formation.

15. The apparatus according to claim 9, further comprising a voltage application unit configured to apply a voltage to a process unit, the process unit forming an image, wherein the voltage or current detection unit is further configured to detect a current that flows to the voltage application unit via the process unit when the voltage application unit applies the voltage to the process unit.

* * * * *